US006625851B1

(12) United States Patent
Martin et al.

(10) Patent No.: US 6,625,851 B1
(45) Date of Patent: Sep. 30, 2003

(54) FASTENING SYSTEM HAVING VERTICAL AND HORIZONTAL ENGAGEMENT

(75) Inventors: Timothy Ray Martin, Alpharetta, GA (US); Richard John Schmidt, Roswell, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/703,047

(22) Filed: Oct. 31, 2000

(51) Int. Cl.[7] ..... A44B 21/00

(52) U.S. Cl. ..... 24/462; 24/459; 24/460

(58) Field of Search ..... 24/30.5 R, 384, 24/387, 389, 427, 428, 459–462, 559–562, 68.2, 585.11, 585.12, 699, DIG. 50, DIG. 51; 383/59, 60, 93, 63–65, 95, 97; 411/437

(56) References Cited

U.S. PATENT DOCUMENTS

| | | | | | |
|---|---|---|---|---|---|
| 781,571 | A | * | 1/1905 | Thomas | 411/437 |
| 1,722,783 | A | * | 7/1929 | Basseches | 411/437 |
| 1,929,083 | A | * | 10/1933 | Sipe | 24/389 X |
| 2,477,914 | A | | 8/1949 | Webb | |
| 3,052,130 | A | * | 9/1962 | Kellogg et al. | 74/105 |
| 3,102,314 | A | | 9/1963 | Alderfer | |
| 3,266,113 | A | | 8/1966 | Flanagan, Jr. | |
| 3,514,815 | A | * | 6/1970 | Evans | 24/30.5 R |
| 3,557,413 | A | | 1/1971 | Engle | |
| 3,661,689 | A | * | 5/1972 | Spanier | 428/33 |
| 3,708,837 | A | | 1/1973 | Chiba | |
| 3,808,648 | A | | 5/1974 | Billarant et al. | |
| 3,869,764 | A | | 3/1975 | Tanaka et al. | |
| 3,879,835 | A | | 4/1975 | Brumlik | |
| 3,955,245 | A | | 5/1976 | Ballin | |
| 4,035,875 | A | | 7/1977 | Kobelt | |
| 4,107,826 | A | | 8/1978 | Tysdal | |
| 4,123,826 | A | | 11/1978 | Tanaka | |
| 4,130,917 | A | * | 12/1978 | Shopalovich | 24/389 |
| 4,198,734 | A | | 4/1980 | Brumlik | |
| 4,271,566 | A | | 6/1981 | Perina | |
| 4,507,878 | A | * | 4/1985 | Semouha | 36/50.1 |
| 4,680,838 | A | | 7/1987 | Astl | |
| 4,819,309 | A | | 4/1989 | Behymer | |
| 4,854,844 | A | * | 8/1989 | Carlsen | 425/141 |
| 4,872,242 | A | * | 10/1989 | Allan | 24/16 PB |
| 4,941,238 | A | * | 7/1990 | Clark | 24/389 X |
| 5,074,731 | A | * | 12/1991 | Schneider | 411/437 |
| 5,087,161 | A | * | 2/1992 | Gunn | 411/433 |
| 5,138,750 | A | | 8/1992 | Gundlach et al. | |
| 5,179,767 | A | * | 1/1993 | Allan | 24/442 |
| 5,181,300 | A | | 1/1993 | Schwarz | |
| 5,187,843 | A | | 2/1993 | Lynch | |
| 5,208,952 | A | | 5/1993 | Mintel et al. | |
| 5,235,731 | A | | 8/1993 | Anzai et al. | |
| 5,259,711 | A | * | 11/1993 | Beck | 410/104 |
| 5,269,776 | A | | 12/1993 | Lancaster et al. | |
| 5,324,279 | A | | 6/1994 | Lancaster et al. | |

(List continued on next page.)

FOREIGN PATENT DOCUMENTS

| | | |
|---|---|---|
| EP | 0 279 599 B1 | 8/1993 |
| GB | 2 138 882 A | 10/1984 |
| WO | 97/02796 | 1/1997 |

*Primary Examiner*—J. J. Swann
*Assistant Examiner*—Ruth C. Rodriguez
(74) *Attorney, Agent, or Firm*—Pauley Petersen Kinne & Erickson

(57) ABSTRACT

A separable fastening system including female component having a channel-like structure into which a male component is inserted. The female component has a lengthwise opening that can be widened for insertion of the male component and can recover to its original shape, thereby enveloping the male component and providing vertical engagement. The female component has depressions or holes on or through a surface of the female component. Protrusions from the male component engage with the depressions or holes, thereby providing engagement in a shear force direction.

41 Claims, 3 Drawing Sheets

U.S. PATENT DOCUMENTS 5,342,344 A 8/1994 Lancaster et al.
RE34,738 E * 9/1994 Brady ..... 24/590.1
5,398,387 A 3/1995 Torigoe et al.
5,440,787 A 8/1995 Figueroa et al.
5,460,769 A 10/1995 Kaneko
5,520,410 A * 5/1996 Sun ..... 280/728.3
5,545,159 A 8/1996 Lancaster et al.
5,634,245 A 6/1997 Rouser et al.
5,657,516 A 8/1997 Berg et al.
5,664,296 A * 9/1997 May ..... 24/30.5 R
5,820,323 A * 10/1998 Barandun ..... 411/171
5,901,419 A 5/1999 Widlund et al.
6,089,807 A * 7/2000 Larsson ..... 411/433
6,092,266 A * 7/2000 Lee ..... 24/389
6,168,361 B1 * 1/2001 Adler ..... 411/433

* cited by examiner

FASTENING SYSTEM HAVING VERTICAL AND HORIZONTAL ENGAGEMENT

FIELD OF THE INVENTION

This invention is directed to a fastening system having male and female components. More particularly, the male and female components lock together and have attachment qualities in both the vertical and horizontal directions.

BACKGROUND OF THE INVENTION

A number of fastening systems incorporate a hook and loop system for easy fastening and release. The hook component typically includes a flat plastic sheet laminate with a number of protruding hooks that engage with a number of loops protruding from a corresponding loop component. Individual hooks engage with individual loops. Such hook and loop fastening systems rely primarily on shear forces that resist unfastening.

Since the shear forces resist unfastening of the hook and loop fastening system, hook and loop components are typically separated from one another using peel forces. However, with little resistance to the peel forces, the hook and loop fastening system is susceptible to coming unfastened at unexpected, and often undesirable, times.

There is a need or desire for a hook and loop fastening system with improved fastening security, particularly in both horizontal and vertical directions.

SUMMARY OF THE INVENTION

The present invention is directed to a fastening system having male and female components that lock together and have attachment qualities in both the vertical and horizontal directions. Each female component includes a tube or channel-like structure made of a flexible material that recovers to its original shape after being stressed. A lengthwise portion of the female component has an access slit or opening to allow insertion of the male component. The male component includes one or more protrusions. The female component has holes or depressions that engage the male component's protrusions, thereby providing horizontal engagement. The exterior sides of the female component resume their original shape, allowing the sides to fold around the male component, thereby providing vertical engagement. The male component fits inside the female component when pushed into place from the opening in the female lengthwise portion. Once the male component is positioned inside the female component, the male component and the female component are both horizontally and vertically engaged, thereby resulting in a reduction in fastener curl and fastener drift compared to conventional fastening systems.

With the foregoing in mind, it is a feature and advantage of the invention to provide a separable fastening system with improved fastening security.

DEFINITIONS

Figure 1:
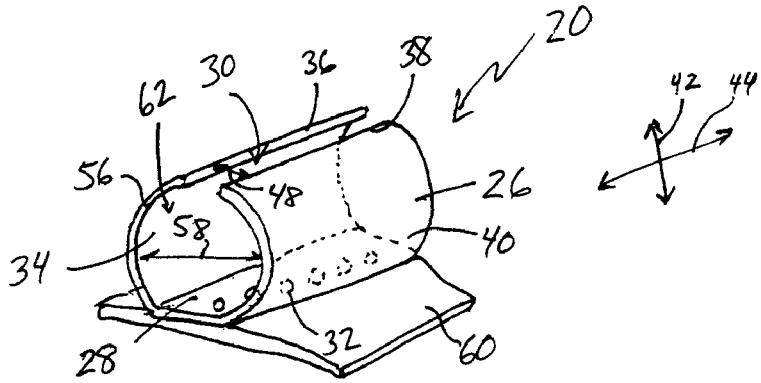
FIG. 1 is a perspective view of a female component.

Within the context of this specification, each term or phrase below will include the following meaning or meanings.

"Channel-like structure" refers to a single trench or a series of trenches, furrows or grooves having a bottom surface and lengthwise walls, with a lengthwise opening between the walls.

"Depressions" include holes, bores, grooves, and other cavities in a surface.

"Flexible" polymers refer to polymeric materials that are compliant and which will readily bend in response to stress, and which tend to snap back to their original conformation when the stress is removed.

"Peel force" refers to a force that tends to pull two adjoining bodies away from one another in opposite directions generally perpendicular to a plane in which the bodies are joined.

"Polymers" include, but are not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the material. These configurations include, but are not limited to isotactic, syndiotactic and atactic symmetries.

"Protrusions" include pins, ribs, embossments, and other projections and protuberances from a surface.

"Releasably attached," "releasably engaged" and variations thereof refer to two elements being connected or connectable such that the elements tend to remain connected absent a separation force applied to one or both of the elements, and the elements being capable of separation without substantial permanent deformation or rupture. The required separation force is typically beyond that encountered while in use.

"Shear force" refers to forces that tend to produce an opposite but parallel sliding motion between two bodies' planes.

"Shear direction" or "shear force direction" refers to a direction parallel to a backing material or other reference surface undergoing shear force.

"Thermoplastic" describes a material that softens when exposed to heat and which substantially returns to a non-softened condition when cooled to room temperature.

These terms may be defined with additional language in the remaining portions of the specification.

DETAILED DESCRIPTION OF THE PRESENTLY PREFERRED EMBODIMENTS

The present invention is directed to a separable fastening system, including a male component and female component, that can remain fastened under high levels of shear force as well as under a certain level of peel force. More particularly, the male and female components lock together and have attachment qualities in both the vertical and horizontal directions. When locked together, the male and female components are releasably attached, or releasably engaged, to one another.

This fastening system is particularly suitable for use on items in which the fastener force has a significant shear force component during use, as well as a peel force component. This fastening system may be applied to a wide range of uses, including commercial, industrial and/or heavy-duty applications. For example, the fastening system can be used on backpacks, camping gear, shoes, and cargo tie-downs.

As shown in FIG. 1, the female component 20 includes a channel-like structure 26 made of a flexible material that can recover to its original shape if stressed. The channel-like structure 26 can have a circular cross-section like a tube (FIG. 2), a rectangular cross-section, or any other suitable cross-sectional shape. When the channel-like structure 26 has at least one flat surface 28 along the length of the component 20, as shown in FIG. 1, the cross-section of the channel-like structure 26 perpendicular to its length has at least one straight line.

Figure 2:
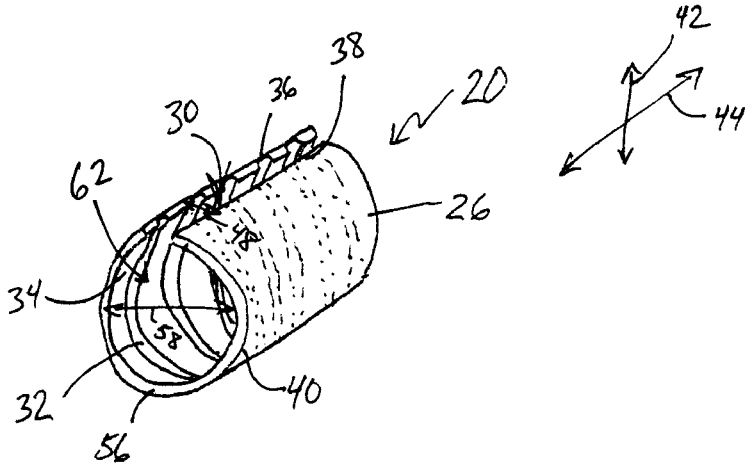
FIG. 2 is a perspective view of a female component.
Figure 3:
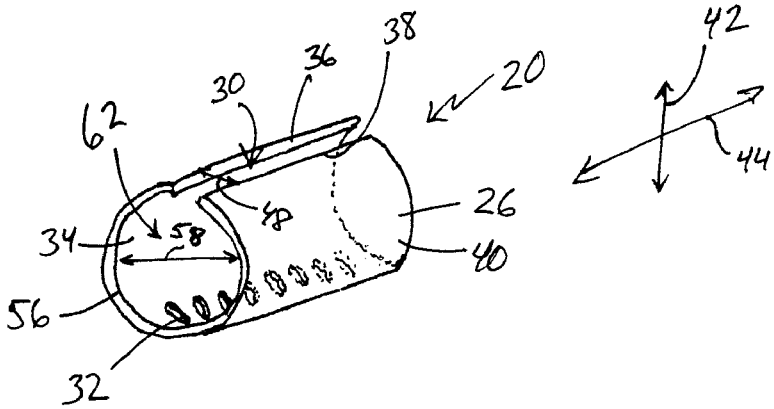
FIG. 3 is a perspective view of a female component.

The channel-like structure 26 has a longitudinal access slit 30, or similar opening, along the length of the component 20 to allow the insertion of the male component 22. The female component 20 has any number of depressions 32 on an interior surface 34 of the component 20. The depressions 32 can be virtually any shape, such as round (FIG. 1) or oblong (FIG. 3). For example, in FIG. 2, the depressions 32 are grooves that extend circumferentially about the female component 20, essentially stretching from a first edge 36 of the lengthwise opening 30 to a second edge 38 of the opening 30. The depressions 32 can be located circumferentially about the female component 20, as shown in FIG. 2, or opposite the lengthwise opening 30, as shown in FIG. 1, or in any other location along the inner surface 34 of the female component 20.

In one embodiment of the invention, the depressions 32 in the female component 20 are holes that penetrate through the inner surface 34 of the female component 20 and through an outer surface 40 of the female component 20, as shown in FIG. 3. The holes 32 may create stronger horizontal engagement between the male and female components 22, 20 than depressions 32 which are shallower. The horizontal engagement is explained in greater detail below.

For reference, arrows 42 and 44 depicting the orientation of the vertical direction and the horizontal direction, respectively, of the male and female components 22, 20 are illustrated in FIGS. 1–5.

Figure 4:
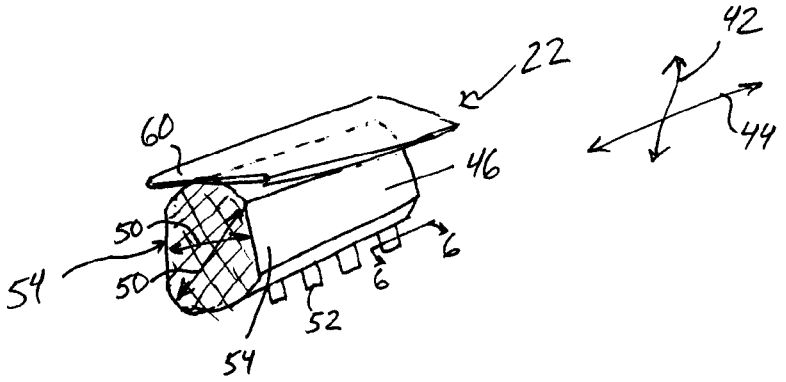
FIG. 4 is a perspective view of a male component.
Figure 5:
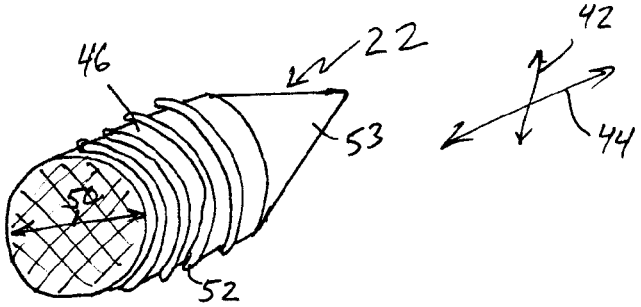
FIG. 5 is a perspective view of a male component.

As shown in FIGS. 4 and 5, the male component 22 includes at least one long, solid or hollow tube or strip 46, configured to slide in through an end opening 62 in the female component 20 or snap into the lengthwise opening 30 in the female component 20 by pushing the walls apart. The female component 20 thereby engages the male component 22, thus enveloping the male component 22 within the female component 20. Suitably, at least 50% of the surface area of the long strip portion 46 of the male component 22 is in contact with the inner surface 34 of the female component 20 during engagement. More suitably, at least 60%, or at least 80%, of the surface area of the long strip portion 46 of the male component 22 is in contact with the inner surface 34 of the female component 20 during engagement.

As mentioned, the female component 20 is suitably made of a flexible material. This material allows the male component 22 to be inserted through the lengthwise opening 30, particularly when the width 48 of the opening is smaller than the diameter 50 of the male component 22. When the lengthwise opening 30 returns to its original width, the male component 22 is then vertically engaged within the female component 20. A reasonable amount of peel force exerted by the wearer or a caretaker is sufficient to unfasten the female component 20 from the male component 22, but the vertical engagement is otherwise sufficient to resist separation caused by normal movements of the wearer during use.

The male component 22 includes any number of protrusions 52 extending outward from the long tube or strip 46. These protrusions 52 engage with the depressions 32 on the inner surface 34 of the female component 20, thereby providing horizontal engagement. The horizontal engagement resists shear force applied to the male and female components 22, 20 during engagement. When the depressions 32 in the female component 20 are holes that penetrate all the way through the wall 56 of the female component 20, the protrusions 52 on the male component 22 are able to extend all the way through the wall 56, thereby creating greater resistance to shear force than shorter protrusions engaged in shallower depressions.

Once the male component 22 is positioned inside the female component 20, the male component 22 and the female component 20 are both horizontally and vertically interlocked, thereby resisting both shear force and peel force.

The long strip portion 46 of the male component 22 can have a circular cross-section like a tube (FIG. 5), a rectangular cross-section, or any other suitable cross-sectional shape. When the long strip portion 46 has at least one flat surface 54 along the length of the component 22, as shown in FIG. 4, the cross-section of the long strip portion 46 then has at least one straight line. In any case, the shape of the male component 22 should be complementary to the female component 20 such that the male component 22 can closely fit within the female component 20.

Figure 6:
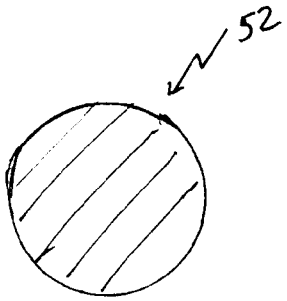
FIG. 6 is cross-section view of a protrusion of a male component, taken along line 6—6 in FIG. 4.
Figure 7:
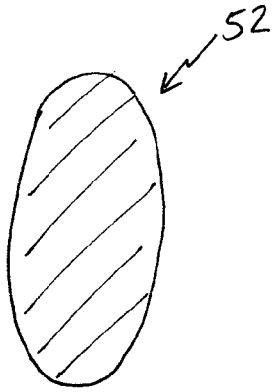
FIG. 7 is a cross-section view of another embodiment of a protrusion of a male component, taken along line 6—6 in FIG. 4.

The protrusions 52 of the male component 22 can be virtually any shape that fits within the depressions 32 on the corresponding female component 20. For example, the protrusions 52 can have a substantially circular cross-section to fit within substantially circular depressions 32, or an oblong cross-section to fit within oblong depressions 32. A circular cross-section of a protrusion 52 in FIG. 4 is shown in FIG. 6. Similarly, an oblong cross-section of a protrusion 52 in FIG. 4 is shown in FIG. 7. In one embodiment, shown in FIG. 5, the protrusions 52 of the male component 22 are shaped like ribs which extend circumferentially around the male component 22, either partially around or entirely around the circumference of the male component 22.

Figure 8:
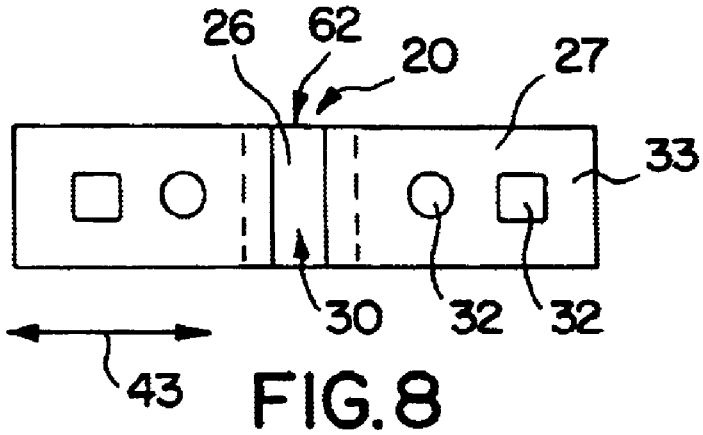
FIG. 8 is a top view of a female component.
Figure 9:
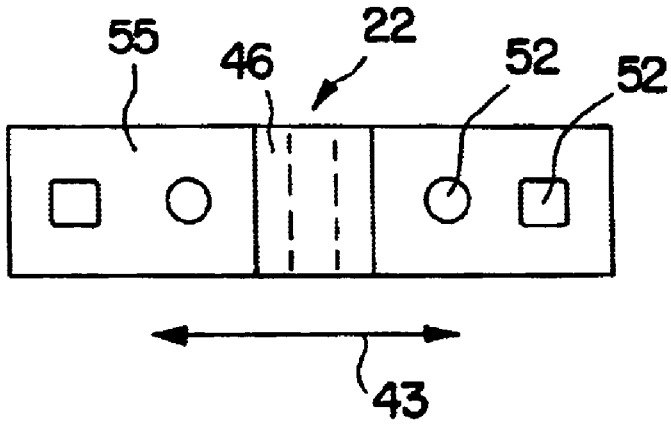
FIG. 9 is a top view of a male component.
Figure 10:
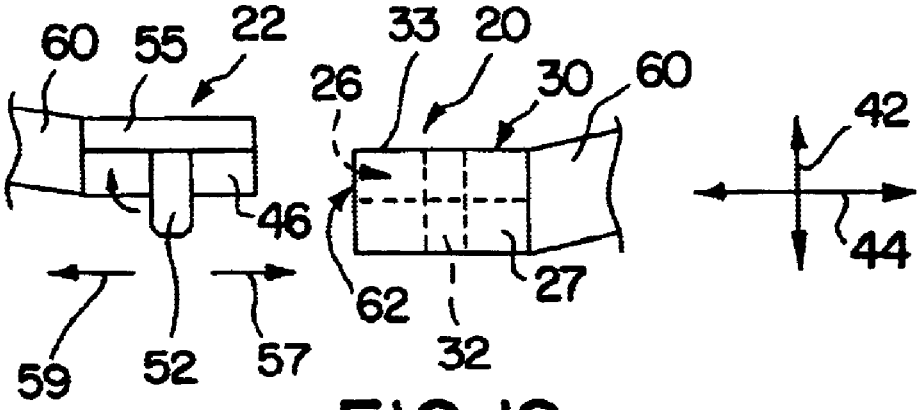
FIG. 10 is a side view of a male component aligned with a female component prior to engagement.

In an alternative embodiment of the invention, shown in FIGS. 8–10, the female component 20 includes a channel-like structure 26 along a length of a base portion 27 of the component 20 to allow the insertion of a strip portion 46 of the male component 22. The base portion 27 of the female component 20 is made of a flexible material that can recover to its original shape if stressed. The channel-like structure 26 can have a circular cross-section, a rectangular cross-section, a trapezoidal cross-section or any other suitable cross-sectional shape. Suitably, an opening 30 of the channel-like structure 26 is narrower than the diameter of the cross-section in at least one area of the cross-section parallel to the opening 30 of the channel-like structure 26.

The female component 20 in this embodiment has any number of depressions 32 on a first surface 33 of the base portion 27 adjacent the channel-like structure 26. The first surface 33 is suitably a substantially flat surface. The depressions 32 can have virtually any shape openings, such as circular or polygonal (FIG. 8).

In another embodiment of the invention, the depressions 32 in the female component 20 are holes that penetrate completely through the base portion 27 of the female component 20, as shown in FIG. 10. The holes 32 may create stronger engagement between the male and female components 22, 20 than depressions 32 which are shallower.

As shown in FIG. 9, the male component 22 includes a solid or hollow strip portion 46, configured to slide in through an end opening 62 in the structure 26 in the female component 20. The female component 20 thereby engages the male component 22, thus enveloping the strip portion 46 within the structure 26.

The strip portion 46 of the male component 22 can have a circular cross-section, a rectangular cross-section, a trapezoidal cross-section or any other suitable cross-sectional shape. In any case, the cross-sectional shape of the strip portion 46 should be complementary to the cross-sectional shape of the channel-like structure 26 such that the strip portion 46 of the male component 22 can closely fit within the channel-like structure 26 of the female component 20.

When the strip portion 46 is slid into and thereby engaged within the channel-like structure 26, the male component 22 and the female component 20 are then engaged with one another in the vertical direction 44. As mentioned, the base portion 27 of the female component 20 is suitably made of a flexible material. A reasonable amount of peel force exerted by the wearer or a caretaker is sufficient to unfasten the female component 20 from the male component 22, but the engagement in the vertical direction 44 is otherwise sufficient to resist separation caused by normal movements of the wearer during use.

The male component 22 includes any number of protrusions 52 extending outward from a base portion 55 adjacent the strip portion 46. These protrusions 52 engage with the depressions 32 in the base portion 27 of the female component 20, thereby providing engagement in a direction, indicated by arrow 43 in FIGS. 8 and 9, perpendicular to both the vertical direction 42 and the horizontal direction 44, shown in FIGS. 1–5 and 10. The engagement in this direction 43 resists shear force applied to the male and female components 22, 20 during engagement. When the depressions 32 in the female component 20 are holes that penetrate all the way through the base portion 27 of the female component 20, the protrusions 52 on the male component 22 are able to extend all the way through the base portion 27 of the female component 20, thereby creating greater resistance to shear force than shorter protrusions 52 engaged in shallower depressions 32.

The protrusions 52 of the male component 22 are suitably inflexible in a first shear direction and flexible in a second shear direction. More specifically, the first shear direction is the direction in which the male component 22 is pulled, or slid, toward the female component 20 such that the strip portion 46 and the structure 26 are in the same plane and are aligned for engagement. The second shear direction is the direction in which the male component 22 is pulled away from the female component 20 once the male component 22 and the female component 20 are engaged. In FIG. 10, the male component 22 and the female component 20 are each attached to a portion of a garment 60. Arrows 57 and 59 in FIG. 10 illustrate the first shear direction and the second shear direction, respectively, with respect to movement of the male component 22. The first shear direction is in a range of between 0 degrees and 90 degrees from the base portion 55 of the male component 22 in the direction of arrow 57. The second shear direction is in a range of between 0 degrees and 90 degrees from the base portion 55 of the male component 22 in the direction of arrow 59. The first and second shear directions should be at least about 30 degrees apart, suitably at least about 45 degrees apart, desirably at least about 60 degrees apart.

When the male component 22 is moved in the first shear direction, the protrusions 52 bend back toward the second shear direction until the protrusions 52 reach the depressions 32, at which point the protrusions 52 fall into the depressions 32. The male component 22 can then be pulled back toward the second shear direction, thereby causing the protrusions 52 to straighten out such that they are fully inserted in the depressions 32. When the male component 22 is pulled back toward the second shear direction, the protrusions 52 are pulled toward the first shear direction, but do not bend in the first shear direction and instead remain upright.

Once the strip portion 46 on the male component 22 is positioned inside the structure 26 in the female component 20, and the protrusions 52 of the male component 22 are positioned in the depressions 32 in the female component 20, the male component 22 and the female component 20 are interlocked in mutually perpendicular directions, thereby resisting both shear force and peel force.

The protrusions 52 of the male component 22 can be virtually any shape that fits within the depressions 32 on the corresponding female component 20. For example, the protrusions 52 can have a substantially circular cross-section to fit within substantially circular depressions 32, or a polygonal cross-section to fit within polygonal depressions 32, examples of which are shown in FIGS. 8 and 9.

In each of the embodiments of the invention, the male component 22 and the female component 20 can both be made of the same flexible material. Suitable flexible polymers for the male and female components 22, 20 of the present invention include polyolefins, polyamides, polyesters, polytetrafluoroethylenes, elastomeric thermoplastic polymers made from block copolymers such as polyurethanes, copolyether esters, polyamide polyether block copolymers, polyester block amide copolymers, ethylene vinyl acetates (EVA), block copolymers having the general formula A-B-A' or A-B like copoly(styrene/ethylene-butylene), styrene-poly(ethylene-propylene)-styrene, styrene-poly(ethylene-butylene)-styrene, (polystyrene/poly(ethylene-butylene)/polystyrene, poly (styrene/ethylene-butylene/styrene) and the like.

Other exemplary elastomeric materials which may be used include polypropylene, polyethylene, or polyurethane elastomeric materials. Examples of such polyurethane elastomeric materials include those available under the trademark ESTANE® from B. F. Goodrich & Co. or MORTHANE® from Morton Thiokol Corp., polyester elastomeric materials such as, for example, those available under the trade designation HYTREL® from E. I. du Pont de Nemours & Company of Wilmington, Del., and those known as ARNITEL®, formerly available from Akzo Plastics of Arnhem, Holland and now available from DSM of Sittard, Holland.

Metallocene catalyzed polymers are another type of material suitable for the male and female components 22, 20 of the present invention. This class of polymers is well known in the art for having excellent elasticity, and a narrow polydispersity number, e.g., Mw/Mn is 4 or less and may be produced according to the metallocene process. The metallocene process generally uses a catalyst which is activated, i.e. ionized, by a co-catalyst.

The depressions in the female component 32 can be molded into the channel-like structure 26 or the base portion 27. Similarly, the protrusions 52 of the male component 22 can be molded into, or co-formed, with the strip portion 46 or the base portion 55 of the male component 22.

The male component 22 of the present invention can generally have as few as one protrusion 52, or a large number of protrusions 52, depending on the size of the protrusions 52 and the size of the male component 22, but the number of protrusions 52 should not be so dense as to interfere with the fastening ability of one another. The protrusions 52 suitably have a height of from about 0.00254 centimeter (cm) to about 2.54 cm, or from about 0.0254 cm to about 2.54 cm.

The female component 20 can generally have as few as one depression 32, or a large number of protrusions 52, suitably equal to or greater than the number of protrusion 52 on the male component 22. The depressions 32 suitably have a depth of from about 0.00254 cm to about 2.54 cm, or from about 0.0254 cm to about 2.54 cm. The thickness of the wall 56 of the channel-like structure 26 of the female component 20 in the embodiments not having a base portion 27 is suitably 0.019 cm to about 0.25 cm, or from about 0.050 cm to about 0.19 cm thick. The thickness of the base portion 27 in those embodiments having a base portion 27 is suitably 0.019 cm to about 5 cm, or from about 0.050 cm to about 2.5 cm thick.

The smallest diameter 58, or smallest cross-sectional width, of the channel-like structure 26 of the female component 20 is the distance measured between one side of the inner surface 34 and the opposite side of the inner surface 34 in the same horizontal cross-section. The channel-like structure 26 in this invention can have an inner diameter in a range of about 0.0254 cm to about 5 cm, more suitably from about 0.254 cm to about 2.54 cm. As mentioned, the cross-section of the channel-like structure 26 is not necessarily circular. Therefore, the cross-section of a single channel-like structure 26 could have several diameter dimensions over a variety of ranges.

The diameter 50 of the strip portion 46 of the male component 22 is suitably the same as the inner diameter 58 of the channel-like structure 26, or within 0.00254 cm to 0.254 cm of the inner diameter 58 of the channel-like structure 26, suitably within 0.005 cm to 0.254 cm of the inner diameter 58 of the channel-like structure 26. As in the case of the channel-like structure 26, the cross-section of a single strip portion 46 could have several diameter dimensions over a variety of ranges.

The strip portion 46 of the male component 22 and the channel-like structure 26 of the female component 20 are suitably the same length as one another. The length can vary greatly depending on the intended use of the fastening system. Suitably, the length of the male and female components 22, 20 can range from about 0.05 cm to about 25.4 cm, more suitably from about 0.254 cm to about 20 cm, most suitably from about 0.1 cm to about 15 cm. Furthermore, an end portion 53 of the strip portion 46 of the mail component 22 can be tapered, as shown in FIG. 5, for ease of inserting the strip portion 46 into the channel-like structure 26 of the female component 20.

Both the male component 22 and the female component 20 can be co-formed with a backing material 60, as shown in FIGS. 1 and 4. The male component backing material and the female component backing material generally have a thickness in a range of between about 0.4 millimeter (mm) and about 1.3 cm, suitably in a range of between about 0.6 mm and 0.64 cm.

The male and female components 22, 20 may be arranged in rows on the backing material 60. The density of the rows on the backing material 60 and the spacing between the rows varies greatly depending on the size of the individual components and the intended application of the fastening system.

It will be appreciated that details of the foregoing embodiments, given for purposes of illustration, are not to be construed as limiting the scope of this invention. Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention, which is defined in the following claims and all equivalents thereto. Further, it is recognized that many embodiments may be conceived that do not achieve all of the advantages of some embodiments, particularly of the preferred embodiments, yet the absence of a particular advantage shall not be construed to necessarily mean that such an embodiment is outside the scope of the present invention.

We claim:

1. A separable fastening system, comprising:

a female component having at least one channel-shaped structure with a lengthwise opening and at least one groove on an inner surface of the component within the at least one channel-shaped structure, wherein the groove extends circumferentially around the channel-shaped structure from a first edge of the lengthwise opening to a second edge of the lengthwise opening; and a male component having at least one protrusion that can bend in a direction of shear force from an upright position, wherein the at least one protrusion engages with the at least one groove in the female component.

2. The fastening system of claim 1, wherein the at least one groove in the channel-shaped structure is opposite the lengthwise opening.

3. The fastening system of claim 1, wherein the male component further comprises at least one strip portion capable of engaging with the at least one channel-shaped structure of the female component.

4. The fastening system of claim 3, wherein the strip portion comprises a substantially circular cross-section.

5. The fastening system of claim 1, wherein the channel-shaped structure comprises a substantially circular cross-section.

6. Camping gear comprising the fastening system of claim 1.

7. A cargo tied own comprising the fastening system of claim 1.

8. A backpack comprising the fastening system of claim 1.

9. A shoe comprising the fastening system of claim 1.

10. A separable fastening system, comprising:

a female component having at least one channel-shaped structure with a lengthwise opening and at least one depression on a surface of the component; and a male component having at least one protrusion that engages with the at least one depression in the female component and at least one strip portion capable of engaging with the at least one channel-shaped structure of the female component, wherein the at least one protrusion of the male component can bend in a direction of shear force from an upright position and extends circumferentially around the at least one strip portion.

11. By The fastening system of claim 10, wherein the strip portion comprises a substantially circular cross-section.

12. The fastening system of claim 10, wherein the channel-shaped structure comprises a substantially circular cross-section.

13. The fastening system of claim 10, wherein the at least one protrusion comprises a substantially circular cross-section.

14. The fastening system of claim 10, wherein the at least one protrusion comprises a polygonal cross-section.

15. The fastening system of claim 10, wherein the at least one depression comprises a circular opening.

16. The fastening system of claim 10, wherein the at least one depression comprises a polygonal opening.

17. Camping gear comprising the fastening system of claim 10.

18. A cargo tie-down comprising the fastening system of claim 10.

19. A backpack comprising the fastening system of claim 10.

20. A shoe comprising the fastening system of claim 10.

21. A separable fastening system, comprising:

a female component having at least one channel-shaped structure with a lengthwise opening and at least one depression on a surface of the component; and a male component having at least one protrusion that engages with the at least one depression in the female component and at least one strip portion capable of engaging with the at least one channel-shaped structure of the female component, wherein the at least one protrusion of the male component can bend in a direction of shear force from an upright position and partially extends circumferentially around the at least one strip portion.

22. The fastening system of claim 21, wherein the strip portion comprises a substantially circular cross-section.

23. The fastening system of claim 21, wherein the channel-shaped structure comprises a substantially circular cross-section.

24. The fastening system of claim 21, wherein the at least one protrusion comprises a substantially circular cross-section.

25. The fastening system of claim 21, wherein the at least one protrusion comprises a polygonal cross-section.

26. The fastening system of claim 21, wherein the at least one depression comprises a circular opening.

27. The fastening system of claim 21, wherein the at least one depression comprises a polygonal opening.

28. Camping gear comprising the fastening system of claim 21.

29. A cargo tie-down comprising the fastening system of claim 21.

30. A backpack comprising the fastening system of claim 21.

31. A shoe comprising the fastening system of claim 21.

32. A separable fastening system, comprising:

a female component having at least one channel-shaped structure within a base portion of the component and at least one hole through the base portion of the component; and a male component having at least one strip portion capable of engaging the at least one channel-shaped structure of the female component, and at feast one protrusion capable of engaging the at least one hole in the base portion of the female component;

wherein the at least one protrusion of the male component, when the male component is pulled in a first shear direction, is flexible in a second shear direction at least about 30 degrees from the first shear direction, and the at least one protrusion engages the at least one hole of the female component when the male component is slid back in the second shear direction.

33. The fastening system of claim 32, wherein the at least one protrusion comprises a substantially circular cross-section.

34. The fastening system of claim 32, wherein the at least one protrusion comprises a polygonal cross-section.

35. The fastening system of claim 32, wherein the at least one hole in the female component is substantially circular.

36. The fastening system of claim 32, wherein the at least one hole in the female component is polygonal.

37. The fastening system of claim 32, wherein the base portion of the female component comprises a substantially flat surface.

38. Camping gear comprising the fastening system of claim 32.

39. A cargo tie-down comprising the fastening system of claim 32.

40. A backpack comprising the fastening system of claim 32.

41. A shoe comprising the fastening system of claim 32.

* * * * *

UNITED STATES PATENT AND TRADEMARK OFFICE

CERTIFICATE OF CORRECTION

PATENT NO. : 6,625,851 B1
DATED : September 30, 2003
INVENTOR(S) : Martin et al.

It is certified that error appears in the above-identified patent and that said Letters Patent is hereby corrected as shown below:

Column 9,
Line 3, should read -- The fastening system of claim 10, wherein the strip --

Column 10,
Line 18, should read -- structure of the female component, and at least one --

Signed and Sealed this

Twentieth Day of January, 2004

JON W. DUDAS
*Acting Director of the United States Patent and Trademark Office*